United States Patent [19]

Itoh et al.

[11] Patent Number: 5,009,976

[45] Date of Patent: Apr. 23, 1991

[54] ELECTROPHOTOGRAPHIC PHOTORECEPTOR

[75] Inventors: Akira Itoh; Kozo Haino, both of Tsukuba, Japan

[73] Assignee: Mitsubishi Paper Mills Limited, Tokyo, Japan

[21] Appl. No.: 484,836

[22] Filed: Feb. 26, 1990

[30] Foreign Application Priority Data

Feb. 27, 1989 [JP] Japan ..... 1-048298

[51] Int. Cl.[5] ..... G03G 5/14

[52] U.S. Cl. ..... 430/59

[58] Field of Search ..... 430/59

[56] References Cited

U.S. PATENT DOCUMENTS

| | | | |
|---|---|---|---|
| 4,150,987 | 4/1979 | Anderson et al. | 430/59 X |
| 4,278,747 | 7/1981 | Murayama et al. | 430/59 X |
| 4,362,798 | 12/1982 | Anderson et al. | 430/59 |
| 4,465,857 | 8/1984 | Neumann et al. | 564/251 |

*Primary Examiner*—David Welsh

*Attorney, Agent, or Firm*—Cushman, Darby & Cushman

[57] ABSTRACT

The present invention provides an electrophotographic photoreceptor which comprises an electroconductive support and, provided thereon, a photosensitive layer containing at least one hydrazone compound represented by the following formula (I):

(I)

wherein $R^1$ and $R^2$ each represents an alkyl, alkenyl, aralkyl, aryl or heterocyclic group which may be substituted, and at least one of $R^1$ and $R^2$ is an alkenyl group and $R^3$ and $R^4$ each represents a hydrogen atom, an alkyl group, an alkoxy group or a halogen atom.

6 Claims, No Drawings

ELECTROPHOTOGRAPHIC PHOTORECEPTOR

BACKGROUND OF THE INVENTION

The present invention relates to an electrophotographic photoreceptor which contains a novel hydrazone compound.

Hitherto, inorganic photoconductive substances such as selenium, cadmium sulfide, zinc oxide and silicon have been known for photoreceptors of electrophotographic system and widely studied and some of them have been put to practical use. Recently, organic photoconductive materials have also been intensively studied as electrophotographic photoreceptors and some of them have been practically used.

In general, inorganic materials are unsatisfactory, for example, selenium photoreceptors have problems such as deterioration in heat stability and characteristics due to crystallization and difficulty in production and cadmium sulfide photoreceptors have problems in moisture resistance, endurance and disposal of industrial waste. On the other hand, organic materials have advantages such as good film-formability, excellent flexibility, light weight, high transparency and easy designing of photoreceptors for wavelength of wide region by suitable sensitization. Thus, organic materials have increasingly attracted attention.

Photoreceptors used in electrophotographic technique are required to possess the following fundamental properties, namely, (1) high chargeability for corona discharge in the dark place, (2) less leakage (dark decay) of the resulting charge in the dark place, (3) rapid release (light decay) of charge by irradiation with light, and (4) less residual charge after irradiation with light.

Extensive research has been made on photoconductive polymers as organic photoconductive substances including polyvinylcarbazole, but these are not necessarily sufficient in film-formability, flexibility and adhesion and besides these cannot be said to have sufficiently possessed the above-mentioned fundamental properties as photoreceptor.

On the other hand, since organic low molecular photoconductive compounds generally do not have film-formability, suitable binders must be used in combination. These compounds are preferred in that properties of film and electrophotographic characteristics can be somewhat controlled by selection of the binders, but organic photoconductive compounds having a high compatibility with binders are limited and at present a few compounds are practically used as electrophotographic photoreceptors.

As mentioned above, various improvements have been made in making of electrophotographic photoreceptors, but none of photoreceptors which are satisfactory in the above-mentioned fundamental properties and have high endurance have not yet been obtained.

SUMMARY OF THE INVENTION

An object of the present invention is to provide an electrophotographic photoreceptor containing an organic photoconductive compound which is superior in compatibility with binders, stable against heat and light and superior in carrier transporting function.

Another object of the present invention is to provide an electrophotographic photoreceptor which is high in sensitivity and less in residual potential.

Still another object of the present invention is to provide an electrophotographic photoreceptor which is high in charge characteristics, shows substantially no reduction of sensitivity even after repeated use and is stable in charge potential.

DESCRIPTION OF THE INVENTION

The above objects have been attained by providing a photosensitive layer containing a hydrazone compound represented by the following formula (I) on an electroconductive support.

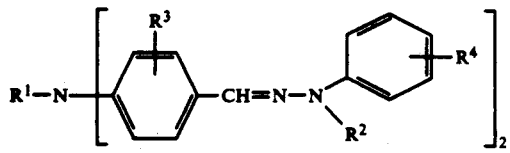

(I)

(wherein $R^1$ and $R^2$ each represents an alkyl, alkenyl, aralkyl, aryl or heterocyclic group which may be substituted, with a proviso that at least one of $R^1$ and $R^2$ is an alkenyl group, and $R^3$ and $R^4$ each represents a hydrogen atom, an alkyl group, an alkoxy group or a halogen atom).

Examples of $R^1$ and $R^2$ are alkyl groups such as methyl, ethyl and propyl, alkenyl groups such as allyl and methallyl, aralkyl groups such as benzyl and $\beta$-phenylethyl, aryl groups such as phenyl and naphthyl, and heterocyclic rings such as pyridyl. Examples of $R^3$ and $R^4$ are hydrogen atom, alkyl groups such as methyl and ethyl, alkoxy groups such as methoxy and ethoxy, and halogen atoms such as chlorine, and bromine.

These hydrazone compounds represented by the formula (I) can be prepared by the processes of the following synthesis examples.

SYNTHESIS EXAMPLE 1 [COMPOUND (13)]

Acetic acid (0.2 ml) was added to a solution comprising 4,4'-(allylimino)bisbenzaldehyde (2.65 g), ethylphenylhydrazine (2.86 g) and ethanol (20 ml), followed by refluxing under heating for 1 hour. After cooling to room temperature, an oily product separated was purified by a silica gel column chromatography to obtain 2.8 g of compound (13) exemplified hereinafter. Yield: 56%; m.p. 98.5°-100° C.

SYNTHESIS EXAMPLE 2 [COMPOUND (15)]

Acetic acid (0.2 ml) was added to a solution comprising 4,4'-(methallylimino)bisbenzaldehyde (2.87 g), ethylphenylhydrazine (3.09 g) and ethanol (18 ml), followed by refluxing with heating for 2.5 hours. After cooling to room temperature, precipitate was collected by filtration and recrystallized from acetonitrile to obtain 3.04 g of compound (15). Yield: 59%; m.p. 116°-120.1° C.

SYNTHESIS EXAMPLE 3 [COMPOUND (18)]

A mixture comprising 4,4'-(crotylimino)bisbenzaldehyde (2.8 g), diphenylhydrazine hydrochloride (4.6 g), sodium acetate (2.0 g) and ethanol (50 ml) was refluxed for 1 hour. After cooling to room temperature, precipitate was collected by filtration and, after removal of inorganic salts, was recrystallized from ethyl acetate to obtain 1.8 g of compound (18). Yield: 29%; m.p. 185°-190° C.

Examples of the hydrazone compounds used in the present invention are enumerated below. The present invention is not limited to these compounds.

(1)
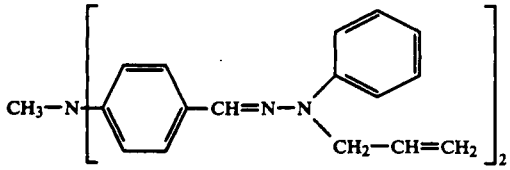
(2)
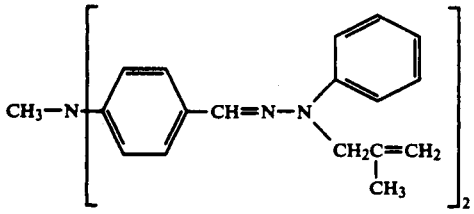
(3)
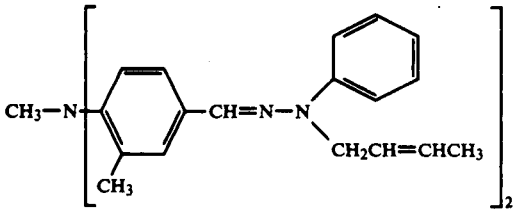
(4)
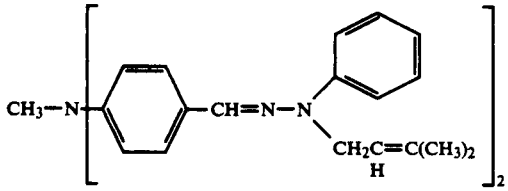
(5)
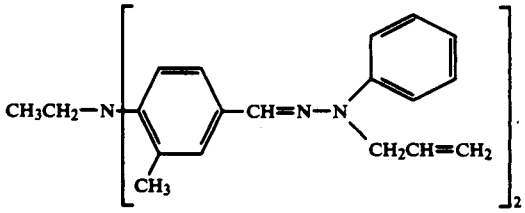
(6)
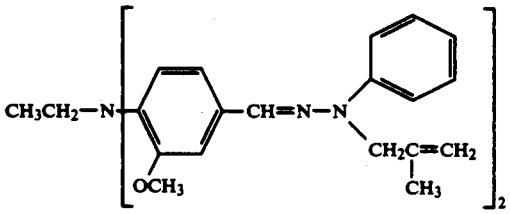
(7)
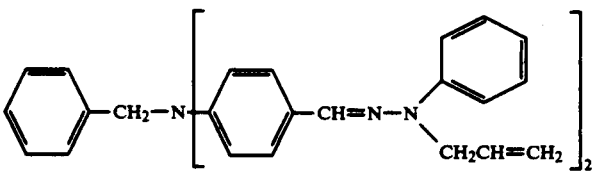

-continued
(8)
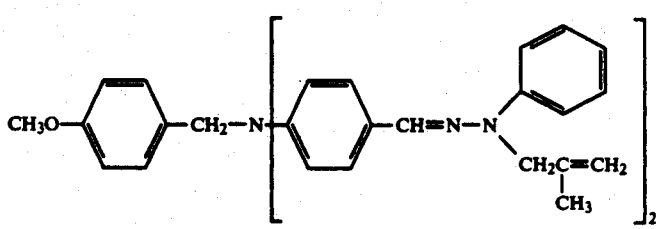
(9)
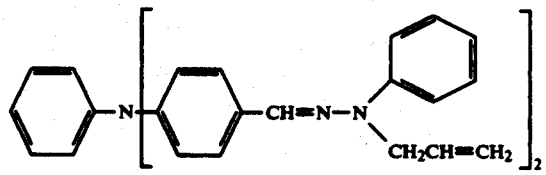
(10)
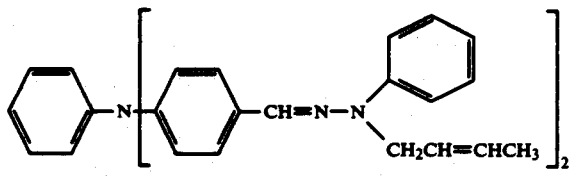
(11)
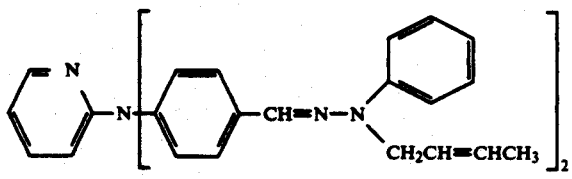
(12)
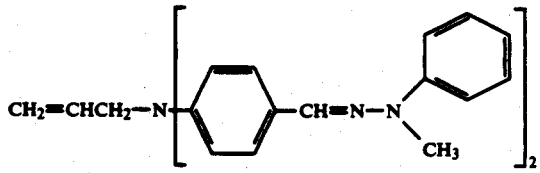
(13)
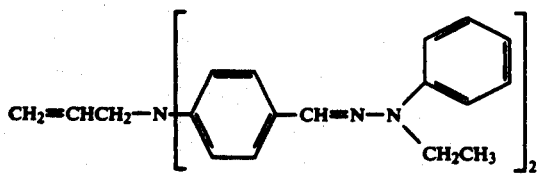
(14)
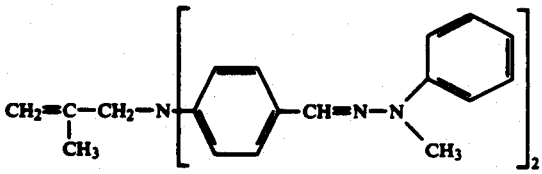
(15)
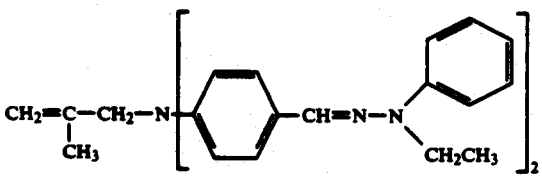

-continued
(16)
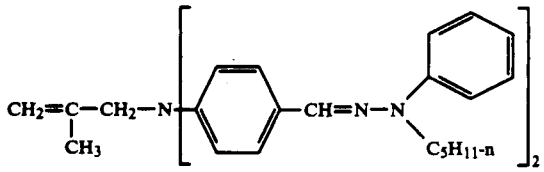
(17)
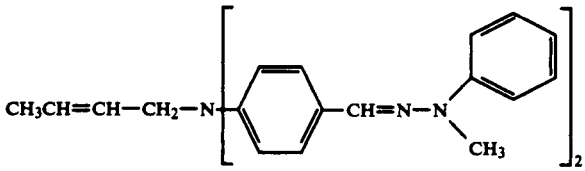
(18)
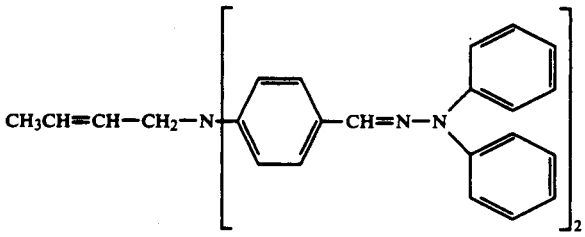
(19)
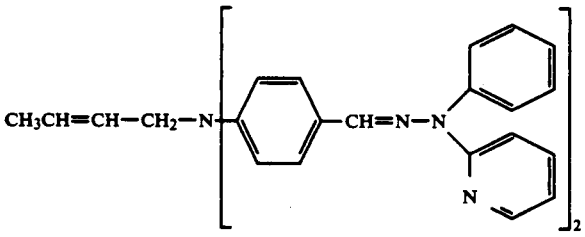
(20)
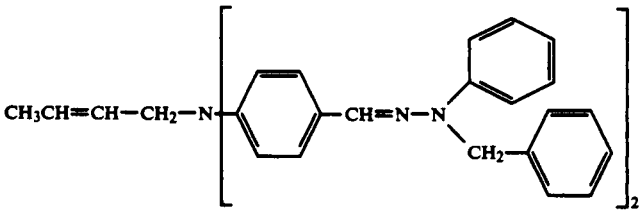
(21)
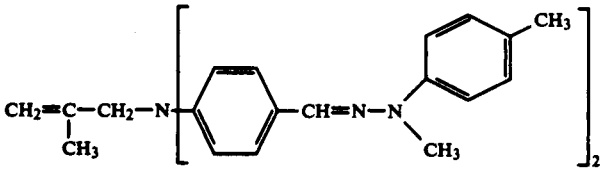
(22)
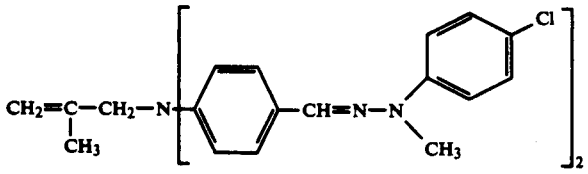

-continued (23)

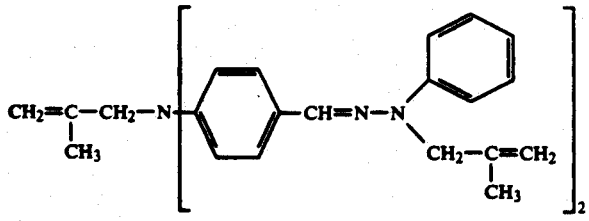

(24)

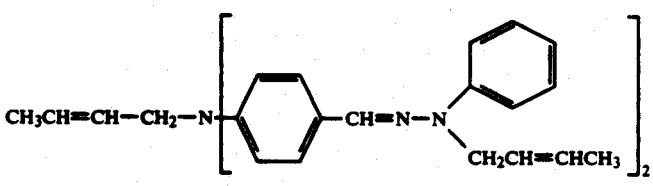

The electrophotographic photoreceptor of the present invention is obtained by containing one or more of the hydrazone compounds as shown above and it has excellent properties.

Various methods have been known for use of these hydrazone compounds as electrophotographic photoreceptor.

For example, there are a photoreceptor which comprises a conductive support on which is coated a solution or dispersion of the hydrazone compound and a sensitizing dye in a binder resin, if necessary, with addition of a chemical sensitizer or an electron attractive compound; a photoreceptor in the form of a double-layered structure comprising a carrier generation layer and a carrier transport layer wherein a carrier generation layer mainly composed of a carrier generation material of high carrier generation efficiency such as dye or pigment is provided on a conductive support and thereon is provided a carrier transport layer comprising a solution or a dispersion of the hydrazone compound in a binder resin, if necessary, with addition of a chemical sensitizer or an electron attractive compound; and such double-layered photoreceptor as mentioned above wherein the carrier generation layer and the carrier transport layer are provided in the reverse order. The hydrazone compound of the present invention can be applied to all of these photoreceptors.

Supports used for preparation of the photoreceptors using the compounds according to the present invention include, for example, metallic drums, metal sheets, and papers, plastic films or belt-like supports which have been subjected to electroconductive treatment.

As film-forming binder resins used for formation of photosensitive layer on the support, mention may be made of various resins depending on fields of application. For example, in case of photoreceptors for use in copying, mention may be made of polystyrene resin, polyvinylacetal resin, polysulfone resin, polycarbonate resin, vinyl acetate/crotonic acid copolymer resin, polyphenylene oxide resin, polyester resin, alkyd resin, polyarylate resin, acrylic resin, methacrylic resin, and phenoxy resin. Among them, polystyrene resin, polyvinylacetal resin, polycarbonate resin, polyester resin, polyarylate resin, and phenol resin are superior in potential characteristics as photoreceptor.

These resins may be used singly or in combination as homopolymers or copolymers.

Amount of these binder resins to be added to the photoconductive compound is 0.2–10, preferably 0.5–5 times the weight of the photoconductive compound. If the amount is less than this range, the photoconductive compound is precipitated in or on the photosensitive layer to cause deterioration in adhesion to the support and deterioration of image quality, and if it is more than the range, sensitivity is reduced.

Further, some of the film-forming binder resins are rigid and low in mechanical strengths such as tensile strength, flexural strength and compression strength and in order to improve these properties, plasticity imparting materials can be added.

These materials include, for example, phthalate esters (such as DOP, DBP and DIDP), phosphate esters (such as TCP and TOP), sebacate esters, adipate esters, nitrile rubber, and chlorinated hydrocarbons. If these materials which impart plasticity are added in an amount more than needed, potential characteristics are deteriorated and so they are added preferably in an amount of 20% by weight or less of binder resin.

The sensitizing dyes added to the photosensitive layer include triphenylmethane dyes represented by Methyl Violet, Crystal Violet, Ethyl Violet, Night Blue, and Victoria Blue, xanthene dyes represented by erythrosine, Rhodamine B, Rhodamine 3B, and Acridine Red B, acridine dyes represented by Acridine Orange 2G, Acridine Orange R and Flaveosine, thiazine dyes represented by Methylene Blue and Methylene Green, oxazine dyes represented by Capri Blue and Meldola's Blue, and other cyanine dyes, styryl dyes, pyrylium salts, thiapyrylium salts and squarylium salt dyes.

As photoconductive pigments which generate carrier at very high efficiency upon absorption of light in photosensitive layer, mention may be made of phthalocyanine pigments such as metal-free phthalocyanine and phthalocyanine containing various metals or metal compounds, perylene pigments such as peryleneimide and perylenic anhydride, and quinacridone pigments, anthraquinone pigments, and azo pigments.

Among these pigments, bisazo pigments, trisazo pigments and phthalocyanine pigments high in carrier generating efficiency afford high sensitivity and thus provide excellent electrophotographic photoreceptors.

The dye added to photosensitive layer can be used singly as a carrier generation material, but joint use of this dye with the pigment can generate carrier at higher efficiency. Furthermore, inorganic photoconductive materials include selenium, selenium-tellurium alloy, cadmium sulfide, zinc sulfide and amorphous silicon.

In addition to the above-mentioned sensitizers (so-called spectral sensitizers), there may be added sensitizers for further increase of sensitivity (so-called chemical sensitizers).

Such sensitizers include, for example, p-chlorophenol, m-chlorophenol, p-nitrophenol, 4-chloro-m-cresol, p-chlorobenzoylacetanilide, N,N'-diethylbarbituric acid, 3-(β-oxyethyl)-2-phenylimino-thiazolidone, malonic acid dianilide, 3,5,3',5'-tetrachloromalonic acid dianilide, α-naphthol, and p-nitrobenzoic acid.

Furthermore, it is also possible to add some electron attractive compounds as sensitizers which form a change transport complex with the hydrazone compound of the present invention to further enhance the sensitizing effect.

As the electron attractive substances, mention may be made of, for example, 1-chloroanthraquinone, 1-nitroanthraquinone, 2,3-dichloronaphthoquinone, 3,3-dinitrobenzophenone, 4-nitrobenzalmalononitrile, phthalic anhydride, 3-(α-cyano-p-nitrobenzal)phthalide, 2,4,7-trinitrofluorenone, 1-methyl-4-nitrofluorenone, and 2,7-dinitro-3,6-dimethylfluorenone.

If necessary, antioxidant, curl inhibitor, etc. may also be added to the photoreceptor.

The hydrazone compound of the present invention is dissolved or dispersed in a suitable solvent together with the above-mentioned various additives depending on the form of photoreceptor, the resulting coating liquid is coated on an electroconductive support mentioned above and is dried to obtain a photoreceptor.

As the coating solvent, for example, halogenated hydrocarbons such as chloroform, dichloroethane, trichloroethane, and trichloroethylene, aromatic hydrocarbons such as benzene, toluene, xylene, and monochlorobenzene, dioxane, tetrahydrofuran, methyl cellosolve, dimethyl cellosolve and methyl cellosolve acetate are used singly or as mixed solvent of two or more of them. If necessary, solvents such as alcohols, acetonitrile, N,N-dimethylformamide, and methyl ethyl ketone may further be added to the above solvents.

The following nonlimiting examples further explain the present invention.

EXAMPLE 1

One part by weight of a pigment represented by the following formula and 1 part by weight of a polyester resin (BYRON 200 manufactured by Toyobo Co., Ltd.) were mixed with 100 parts by weight of tetrahydrofuran and the mixture was dispersed together with glass beads for 2 hours by a paint conditioner.

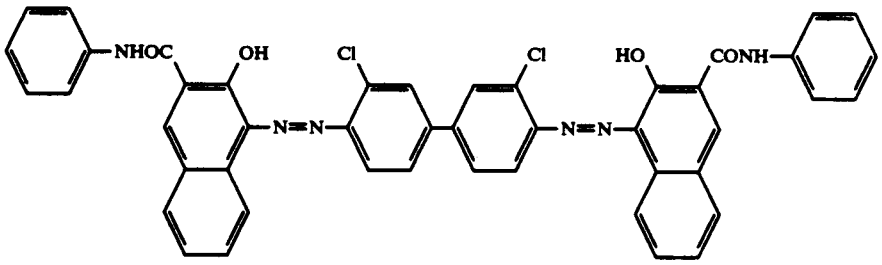

The resulting pigment dispersion was coated on an aluminum-vapor deposited polyester film by an applicator and dried to form a film of carrier generation material of about 0.2μ thick.

Then, the hydrazone compound (17) exemplified hereinbefore was mixed with a polyarylate resin (U-POLYMER manufactured by Unitika Ltd.) at a weight ratio of 1:1 and a 10% solution of the mixture in dichloroethane as a solvent was prepared. This solution was coated on the film of carrier generation material formed hereabove by an applicator to form a carrier transport layer having a dry thickness of 20μ.

Electrophotographic characteristics of the resulting double-layer type electrophotographic photoreceptor were evaluated by an electrostatic recording paper testing apparatus (SP-428 manufactured by Kawaguchi Denki Seisakusho Co.).

Measuring conditions: Applied voltage −6 KV, static No. 3.

As a result, half decay exposure with white light was 2.1 lux·sec which means very high sensitivity.

In addition, evaluation for repeated use was conducted using this apparatus. Change in charge potential due to repeated uses of 1000 times was measured. The initial potential at the first time was −770 V and that at 1000th time was −750 V. Thus, it can be seen that reduction of potential due to repeated use was small and potential was stable. The surface of this photoreceptor was observed to recognize no precipitation of crystal caused by poor compatibility with binder and the surface was in good condition.

COMPARATIVE EXAMPLE 1

A double-layer type photoreceptor was produced in the same manner as in Example 1 except that the following comparative compound (1) was used in place of the hydrazone compound used in Example 1. After cooling, innumerable fine crystals were precipitated on the surface of this photoreceptor.

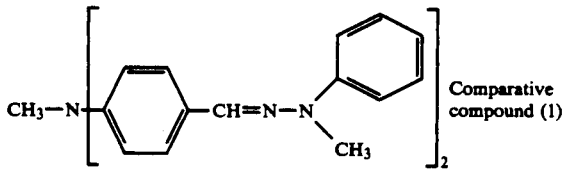

EXAMPLES 2-5

Double-layer type photoreceptors were produced in the same manner as in Example 1 except that hydrazone compounds shown in Table 1 were used in place of the hydrazone compound used in Example 1. Half decay exposure El/2 (lux·sec) and initial potential $V_o$ (volt) were measured under the same measuring conditions as in Example 1 and the results are shown in Table 1. Further, the photoreceptors were subjected to repeated test cycles of 1000 times, one test cycle consisting of charging and removing of potential (removal of potential was carried out by exposing to white light of 400 lux for 1 second) and initial potential $V_o$ (volt) and half decay exposure El/2 are shown in Table 1. The surface of these photoreceptors was observed to recognize no precipitation of crystal caused by poor compatibility with binder and the surface was in good condition.

TABLE 1

| Example | Hydrazone compound | The 1st time $V_0$ (volt) | The 1st time $E_{\frac{1}{2}}$ (lux · sec) | The 1000th cycle $V_0$ (volt) | The 1000th cycle $E_{\frac{1}{2}}$ (lux · sec) |
|---|---|---|---|---|---|
| 2 | (1) | −710 | 2.0 | −690 | 2.0 |
| 3 | (15) | −680 | 1.9 | −670 | 1.9 |
| 4 | (16) | −770 | 1.9 | −750 | 1.8 |
| 5 | (23) | −750 | 2.0 | −750 | 2.0 |

EXAMPLES 6-9

A bisazo pigment of the following structure was used as charge generation material.

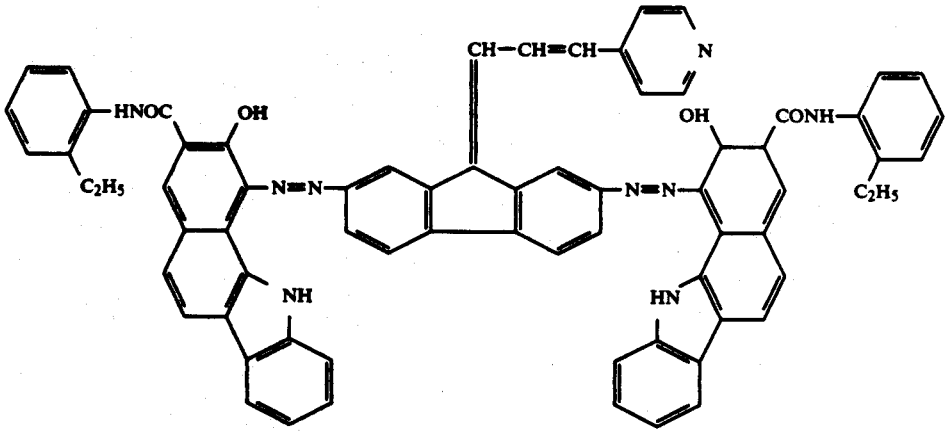

That is, 1 part by weight of this pigment and 1 part by weight of a polyester resin (BYRON 200 manufactured by Toyobo Co., Ltd.) were mixed with 100 parts by weight of tetrahydrofuran and the mixture was dispersed by a paint conditioner together with glass beads for 2 hours. The resulting pigment dispersion was coated on the same support as used in Example 1 by an applicator to form a carrier generation layer. Thickness of this thin film was about 0.2μ.

Then, a carrier transport layer was formed in the same manner as in Example 1 using the compounds as shown in Table 2 to obtain double-layer photoreceptors. These photoreceptors were evaluated under the same measuring conditions as in Example 1. The results are shown in Table 2. The surface of these photoreceptors was observed to recognize no precipitation of crystal caused by poor compatibility with binder and the surface was in good condition.

TABLE 2

| Example | Hydrazone compound | The 1st time $V_0$ (volt) | The 1st time $E_{\frac{1}{2}}$ (lux · sec) | The 1000th cycle $V_0$ (volt) | The 1000th cycle $E_{\frac{1}{2}}$ (lux · sec) |
|---|---|---|---|---|---|
| 6 | (1) | −670 | 1.2 | −660 | 1.1 |
| 7 | (13) | −720 | 1.3 | −710 | 1.2 |
| 8 | (15) | −710 | 1.2 | −690 | 1.2 |
| 9 | (27) | −690 | 1.1 | −690 | 1.1 |

COMPARATIVE EXAMPLE 2

A double-layer type photoreceptor was produced in the same manner as in Examples 6-9 except that the following comparative compound (2) was used in place of the hydrazone compounds used in Examples 6-9. Electrophotographic characteristics of this photoreceptor were measured. The initial potential at the first time was −700 V and this potential decreased to −550 V at the 1000th time.

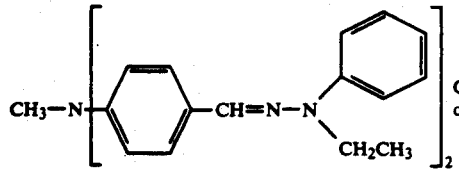

Comparative compound (2)

What is claimed is:

1. An electrophotographic photoreceptor which comprises an electroconductive support and, provided thereon, a photosensitive layer which comprises a carrier generation layer containing a carrier generation material and a carrier transport layer containing at least one hydrazone compound as a carrier transport material represented by the following formula (I):

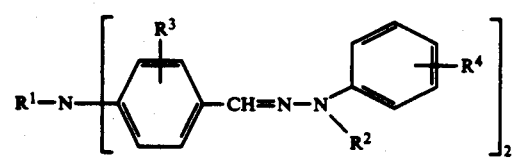

(I)

wherein $R^1$ and $R^2$ each represent an alkyl, alkenyl, aralkyl, aryl or heterocyclic group which may be substituted, and at least one of $R^1$ and $R^2$ is an alkenyl group and $R^3$ and $R^4$ each represents a hydrogen atom, an alkyl group, an alkoxy group or a halogen atom.

2. An electrophotographic photoreceptor according to claim 1, wherein the photosensitive layer comprises a binder resin in which the hydrazone compound is dissolved or dispersed.

3. An electrophotographic photoreceptor according to claim 2, wherein amount of the binder resin is 0.2-10 times the weight of the hydrazone compound.

4. An electrophotographic photoreceptor according to claim 2, wherein the binder resin is one selected from the group consisting of polystyrene resin, polyvinylacetal resin, polycarbonate resin, polyester resin, polyarylate resin and phenol resin.

5. An electrophotographic photoreceptor according to claim 1, wherein the carrier generation material is a pigment selected from the group consisting of bisazo pigment, trisazo pigment and phthalocyanine pigment.

6. An electrophotographic photoreceptor according to claim 1, wherein the electroconductive support is a metallic drum, a metallic sheet, or a paper, plastic film or belt-like support subjected to electroconductive treatment.

* * * * *